US005232301A

United States Patent [19]

Bianco

[11] Patent Number: 5,232,301

[45] Date of Patent: Aug. 3, 1993

[54] NOTEBOOK BINDER WITH ROTATABLE MOUNTING BRACKET

[75] Inventor: Ronald M. Bianco, Irvine, Calif.

[73] Assignee: Day Runner, Inc., Fullerton, Calif.

[21] Appl. No.: 897,902

[22] Filed: Jun. 12, 1992

[51] Int. Cl.[5] ..... B42D 3/12; B42D 3/18; B42F 13/40

[52] U.S. Cl. ..... 402/73; 281/29; 281/31; 281/45; 281/51; 402/79; 402/80 R

[58] Field of Search ..... 281/15.1, 19, 29, 31, 281/45, 51; 402/73, 79, 80 R

[56] References Cited

U.S. PATENT DOCUMENTS

| | | | |
|---|---|---|---|
| 146,937 | 1/1874 | Moore . | |
| 217,733 | 7/1879 | Ellsworth . | |
| 311,220 | 10/1890 | Kam | 281/15.1 |
| 2,287,390 | 6/1942 | Michael | 281/4 |
| 2,467,656 | 4/1949 | Broughton | 281/19 |
| 3,091,482 | 5/1963 | Cirigliano | 281/33 |
| 4,049,119 | 9/1977 | Wilson | 206/387 |
| 4,109,889 | 8/1978 | Durket | 248/447 |
| 4,832,191 | 5/1989 | Gerver et al. | 206/232 |
| 4,838,724 | 6/1989 | Spence, Jr. | 402/79 |
| 4,911,476 | 3/1990 | Garza | 281/29 |
| 4,918,632 | 4/1990 | York | 364/708 |
| 5,048,869 | 9/1991 | Schwartz | 281/16 |
| 5,058,736 | 10/1991 | Bedol | 206/214 |

FOREIGN PATENT DOCUMENTS

| | | |
|---|---|---|
| 170723 | 10/1904 | Fed. Rep. of Germany . |
| 2459142 | 6/1979 | France . |
| 2587650 | 9/1986 | France . |
| 215159 | 4/1967 | Sweden . |

*Primary Examiner*—Paul A. Bell
*Attorney, Agent, or Firm*—Pretty, Schroeder, Brueggemann & Clark

[57] ABSTRACT

A binder includes a notebook, a rotatable mounting assembly and an electronic processor secured to the notebook by the mounting assembly. The mounting assembly includes a frame pivotally connected to an outer edge of a notebook cover and a slip case pivotally attached to the frame. The slip case releasably secures an electronic processor such that the processor can be rotated relative to the cover to any position between a retracted position adjacent the cover inside surface and a fully extended position adjacent the cover outside surface. At the same time, the electronic processor can be selectively rotated within the frame to face any desired direction.

26 Claims, 3 Drawing Sheets

NOTEBOOK BINDER WITH ROTATABLE MOUNTING BRACKET

BACKGROUND OF THE INVENTION

The present invention relates to an attachment for notebook binders, and more particularly to an attachment secured to a ring binder and supporting an article such as an electronic calculator, an electronic organizer or a palm top computer. These items are collectively referred to as "electronic processors" and may be used both independently of, or in conjunction with, information contained within the binder.

In recent years many electronic processors have become sufficiently small and inexpensive that it may be desirable to keep the processing system with a specific binder. The binder may contain documents related to a special project or class of projects. It is thus desirable to affix an electronic processor to a binder in such a way that it can be easily and conveniently used while assuring that it remains associated with the binder.

For optimal utility, such attachments should be firmly and securely affixed to the binder, in a manner that renders the article usable inside, outside, or alongside the binder. When the article is not being used, it is advantageous to position the article so that the keyboard and the display screen, typically the most sensitive components of the article, are protected.

The typical currently available device for attaching electronic calculators and the like to a ring binder is a substantially flat rectangular panel, commonly made of plastic, with apertures near one of its edges adapted to be mounted on two or more of the binder's rings. The article is usually secured to the panel so that when the panel is mounted inside the binder, the keyboard and the display screen are consistently accessible on one side of the rings.

Thus, while the panel can be mounted on the rings of the binder in a conventional manner anywhere between the front and back covers, the article secured to the panel can not be accessed concurrently with information from the same side of the rings. Even if the article is to be accessed concurrently with information found on the opposite side of the rings, but spread over a number of different pages, the panel must be repeatedly dismounted and remounted on the rings of the binder if it is to be accessible concurrently with that information. This is cumbersome and clearly undesirable. Moreover, on occasion it may be beneficial to use the article independently of information contained within the binder while the binder is being closed, but without detaching it from the binder. This is clearly impossible when the article is secured to a panel mounted on the rings of the binder.

The above drawbacks limit the utility of most currently available devices for attaching articles such as electronic calculators, other electronic processors or other devices to ring binders. It should, therefore, be appreciated that there is a need for an improved ring binder attachment which would reliably secure such articles to a binder, be conveniently usable in conjunction with, as well as independently of, information contained within the binder, and be readily accessible inside, outside or alongside the binder. The article should also be readily removable to enable functions such as convenient replacement of batteries, exchange or addition of printed circuit cards or modems, downloading onto RAM cards and/or connection to a separate processor such as a personal computer or printer. The present invention fulfills that need.

SUMMARY OF THE INVENTION

A convenient, yet inexpensive, binder assembly in accordance with the present invention includes a notebook having front and rear covers, connected by a spine, a mounting bracket including at least one hinge secured to one of the covers, a frame pivotally secured to the one cover by the hinge, a slipcase rotatably mounted on the frame, and an article such as a small electronic device secured to the slipcase.

Each of the covers has an interior surface and an exterior surface, as well as an inner edge and an outer edge. The inner edge of at least the one cover is pivotally connected to the spine. The hinge is secured to a flat panel which is in turn secured to one cover of the notebook. The panel is advantageously secured to the notebook cover by inserting the panel between a fabric covering on the inside of the notebook and a typically cardboard panel which defines the shape of the notebook cover. This fastening technique leaves the hinges just outside the one cover adjacent the outer edge.

The frame may be generally U-shaped having a center portion which extends along the outer edge of the one cover, and two end portions that extend at right angles from the center portion. The center portion of the frame may be secured by hinges to the flat panel. Each hinge is adapted to allow the frame to be placed anywhere between a retracted position in which the frame is on top of the interior surface of the one cover and an extended position in which the frame is on top of the exterior surface of the one cover. The slipcase may be rotatably mounted between the two end portions of the frame. The article is typically an electronic device such as a calculator, a palm top computer, an electronic organizer, a clock with alarms, a voice recorder or a phone dialing device. Alternatively, the article may be a note pad, e.g. a self adhesive note pad. The slipcase is adapted to expose a working surface of the article when the article is secured within the slipcase.

Since the frame is pivotable on the hinge mounted adjacent to the outer edge of the one cover between the retracted position and the extended position and the slipcase is rotatable 360 degrees relatively to the frame, when the frame is in the retracted position the working surface of the article is capable of being selectively rotated to positions facing either towards or away from the interior surface of the one cover. When the frame is in the extended position, the working surface of the article is capable of being selectively rotated to positions facing towards or away from the exterior surface of the one cover.

When the article is not being used, the working surface of the article is advantageously positioned to face the interior surface of the one cover for maximum protection. When the article is to be used within the binder, the slipcase may be rotated on the frame so that the working surface of the article faces away from the interior surface of the one cover. When the article is to be used in conjunction with information contained within the binder, it is advantageous to extend the frame alongside the one cover so that the working surface and the information within the binder are accessible concurrently. When the article is to be used independently of the information within the binder, the binder may be closed with the frame in the extended position and the slipcase rotated on the frame so that the working surface faces away from the exterior surface of the one cover.

The hinge of the invention may alternatively be secured directly to the outer edge of the cover. However, for long term reliability it is advantageous to secure the hinge to a flat panel that is adapted to be secured to the cover. Such panel is typically molded of fairly rigid plastic and includes a relatively wide, thin portion and a relatively narrow thick portion. The cover is adapted to form a flat pocket between the interior and the exterior surfaces of the cover. The pocket is accessible through a slit in the interior surface of the cover. The thin portion of the panel is adapted to be inserted into the flat pocket in the cover, thereby stiffening the cover and securing the panel to the binder. The cover may further define a recess for receiving the thick portion of the panel such that the cover and the thick portion of the panel fit together to form a smooth planar surface. Alternatively, the thick portion of the panel may extend in a substantially parallel adjacent relationship with the outer edge the cover to form a sturdy extension of the one cover. The thick portion is stronger and more resilient than a typical binder cover, and therefore better able to support the bulk and weight of the frame, the slipcase, and the article.

It will be appreciated that if it were advantageous to secure the article to the rear cover, rather than the front cover, in most instances all that is required is to turn the binder upside down, and either reposition the article in the slipcase, or remount the slipcase, along with the article, upside down on the frame. The panel, the frame, the slipcase and the hinges can all be made from a variety of materials. The preferred material is semi-rigid thermoplastic material such as polycarbonate.

A feature of the present invention is the use of a slipcase that permits easy removal of the article, e.g. an electronic device, for replacement of batteries, linkage to a PC, downloading of data onto a RAM card, substitution of another electronic device having a different function, placement of the working surface of the article face down in the slipcase for further protection against damage, or simply to permit the electronic device to be removed from the binder and carried separately.

BRIEF DESCRIPTION OF THE DRAWINGS

Other features and advantages of the present invention will become apparent from the following detailed description thereof, taken in conjunction with the accompanying drawings in which.

DESCRIPTION OF THE PREFERRED EMBODIMENT

Figure 1:
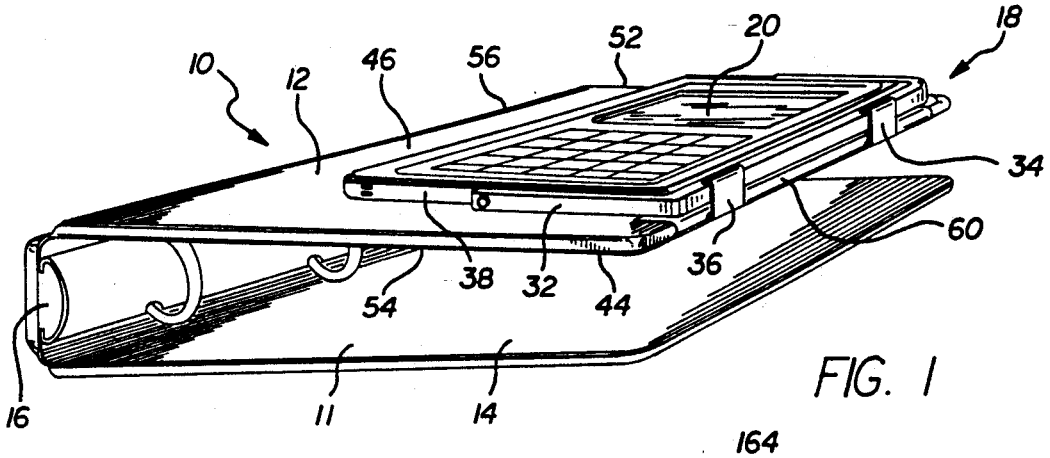
FIG. 1 is a perspective view of a binder made in accordance with the present invention that includes a mounting bracket for an electronic processor with the electronic processor in a fully extended position on top of the exterior surface of the front cover and facing away from the exterior surface of the front cover.
Figure 2:
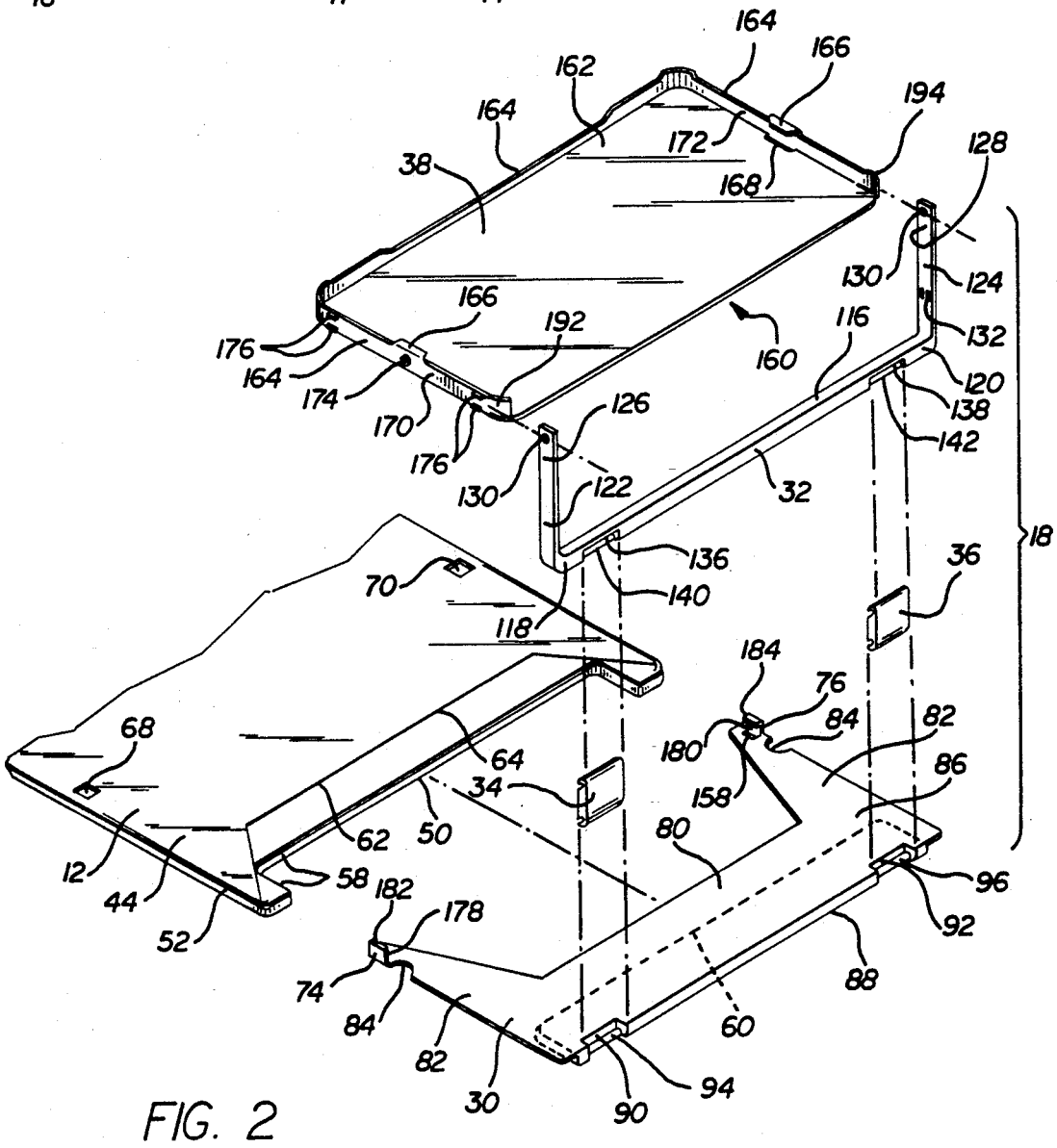
FIG. 2 is an exploded view of the mounting bracket shown in FIG. 1 for securement to an interior surface of the front cover of the binder.

Referring now to FIGS. 1 and 2, a convenient yet inexpensive binder 10 in accordance with the invention includes a notebook 11 having a front cover 12, a rear cover 14, a spine 16 connecting the two covers, and a mounting bracket or assembly 18 for holding an article such as an electronic processor 20 that is to be secured by mounting assembly 18. The mounting assembly 18 includes a panel 30, a frame 32 secured to the panel 30 by two hinges 34 and 36, and a slipcase 38 pivotally secured to the frame 32. The electronic processor 20 is received within the slipcase 38 and is shown by way of example to be an electronic calculator but could alternatively be any of several different articles such as an electronic organizer or a palm top computer.

The front cover 12 has an interior surface 44 and an exterior surface 46, a top edge 52, a bottom edge 54, an inner edge 56, and a recessed edge 58 defining a recess 50. The panel 30 has an extension 60 positioned within the recess 50. The interior surface 44 and the exterior surface 46 of the front cover 12 have a thin fabric outer cover that surrounds a flat stiffening panel (not shown) and forms a flat pocket 62. A slit 64 is cut in the fabric outer cover on the interior surface 44 of cover 12 to form an opening for the pocket 62. The panel 30 is then inserted into the pocket to secure the mounting assembly 18 to cover 12. Extension 60 is somewhat thicker than the rest of panel 30 and approximately matches cover 12 in thickness.

The fabric covering the interior surface 44 of the front cover 12 includes two apertures 68 and 70 positioned relatively closer to the inner edge 56 than the recess 50, adjacent the top and bottom, respectively, of the front cover 12. A pair of tabs 74, 76 extend upward from panel 30 through the apertures 68, 70, respectively, to secure panel 30 to cover 12. Tabs 74, 76 also serve to engage and secure the slipcase 38 as shown in FIGS. *9b* and *9d*.

Figure 9A:
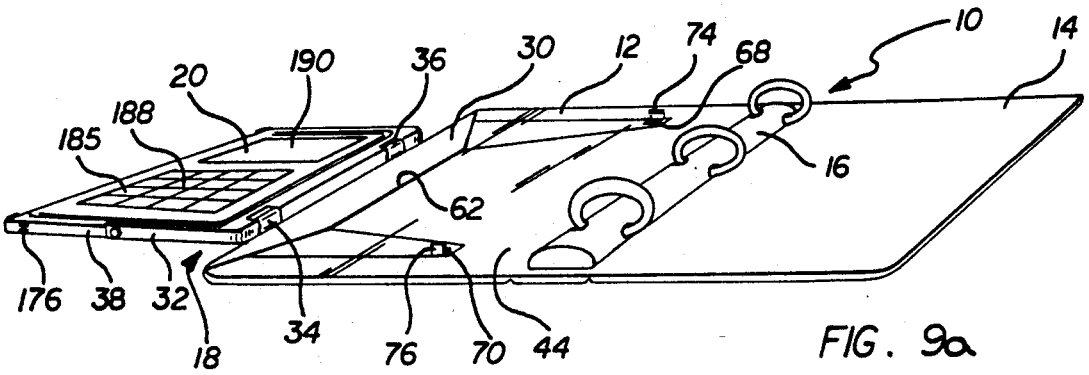

The mounting assembly is illustrated in alternative positions relative to cover 12 in FIGS. 1 and *9a–9d*. In FIG. *9a*, frame 32 is rotated substantially 180 from the retracted position to place electronic processor 20 in coplanar relationship with cover 12 beyond the outer edge of cover 12. Electronic processor 20 remains face up. In FIG. *9b*, the frame 32 is in a retracted position with electronic processor 20 face up. In FIG. *9c*, the frame 32 is rotated approximately 90 degrees while the electronic processor 20 remains face up. In FIG. 9*d*, frame 32 is in the retracted position with electronic processor 20 rotated to be face down, protecting the face from damage. In FIG. 1, the frame 32 has been rotated substantially 360 degrees to a fully extended position with electronic processor 20 disposed against the exterior surface 46 of cover 12 facing away therefrom.

Figure 5:
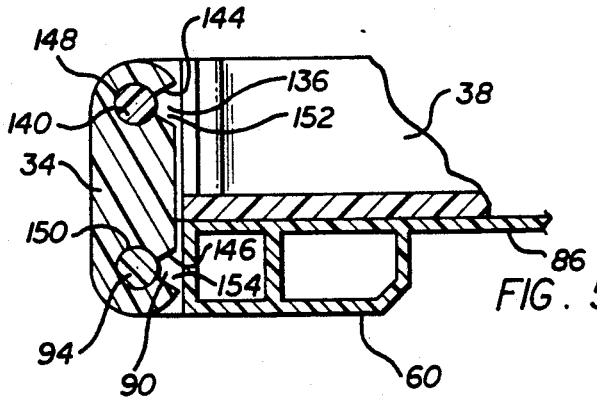
FIG. 5 is a sectional view taken along line 5—5 of FIG. 3 showing the double hinge connector secured to the panel and the frame of the mounting bracket.

With reference to FIGS. 2 and 5, the extension 60 is a portion of panel 30 which further includes a relatively wider and thinner portion 86 adapted to be inserted into the pocket 62 (and thus hidden from view in FIGS. 9*a*–9*d* but shown in FIG. 2) which extends from one side of the extension 60. The portion 86 may be a generally flat, thin, rectangular plate, but is preferably a base portion 80 that is molded to extension 60 and two trapezoidal legs 82 extending from the base portion away from the extension 60. This latter design saves material costs and reduces the overall thickness of portion 86 because large flat areas are difficult to mold into relatively thin plates. The two posts or tabs 74 and 76 project in parallel relationship at right angles from the end of the legs 82. When portion 86 of the panel 30 is completely inserted in the pocket 62 of the front cover 12, the extension 60 is in an abutting, parallel relationship with the recess 58 of the cover 12, and the posts 74 and 76 project through the apertures 68 and 70, respectively, in the interior surface 44 of the front cover 12. Each leg also defines a semicircular opening 84 wherein the panel 30, after it is inserted into the pocket 62, may be secured to the fabric of the cover 12 by a heat sealed, spot weld connection or a sewn connection at a location within the semicircular opening.

The extension 60 includes an outer edge 88 opposite the wider and relatively thinner plate portion 86. Outer edge 88 of extension 60 has two recesses 90, 92 defined therein with pins 94, 96, respectively, extending across the recesses 90, 92. One end of each hinge 34, 36 is received by the recesses 90, 92 and secured to the extension 60 by pins 94, 96, respectively.

Figure 3:
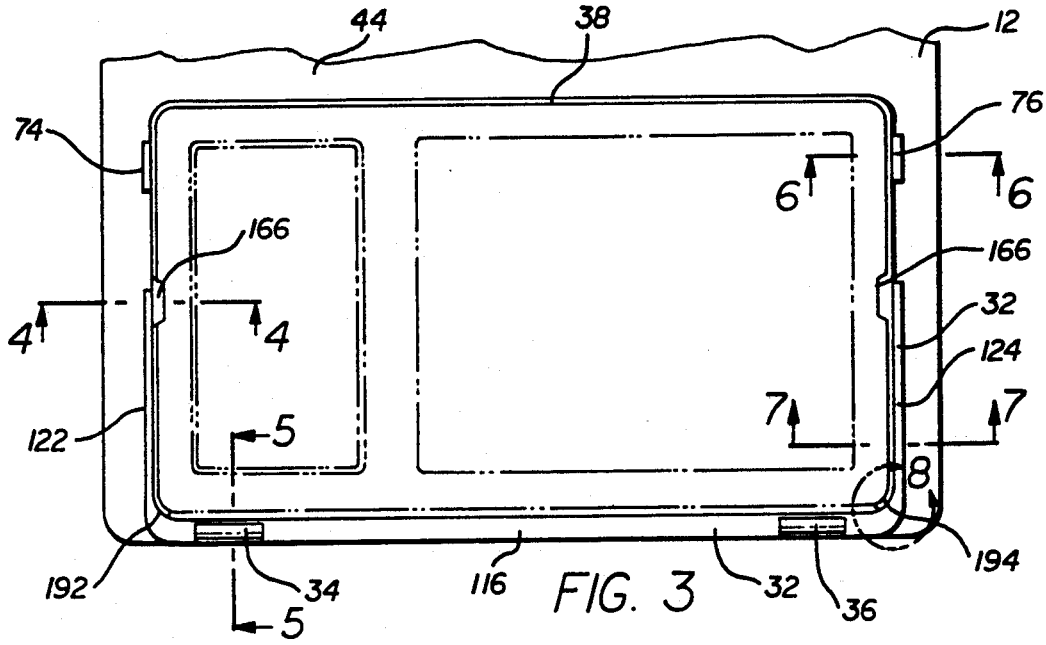
FIG. 3 is a plan view of the assembled mounting bracket shown in FIG. 2 with an electronic processor (shown in phantom) illustrated in a retracted position on the interior surface of the front cover of the binder.

With reference now to FIGS. 2 and 3, the frame 32 is generally U-shaped, with a center portion 116 which extends along the outer edge 88 of the extension 60 and includes a top end 118, a bottom end 120 and two end portions 122 and 124 that extend in parallel spaced relationship, at right angles from one side of the center portion 116, adjacent the top end 118, and the bottom end 120, respectively. The two end portions 122 and 124 each include a fixed end, secured to the center portion 116, and a free end 126, 128. The center portion 116 and the two end portions 122, 124 each include an inner edge and an outer edge. The inner edge of each end portion 122, 124 includes a bore 130 adjacent the free end, and a pair of notches 132 between the bore 130 and the center portion 116. The center portion 116 of the frame 32 has a pair of recesses 136, 138 for receiving hinges 34, 36, respectively. Pins 140, 142 extend across recesses 136, 138 respectively to engage and rotatably secure the frame 32 to the end of the hinges 34, 36 opposite the end that is rotatably secured to extension 60 of flat panel 30.

Figure 4:
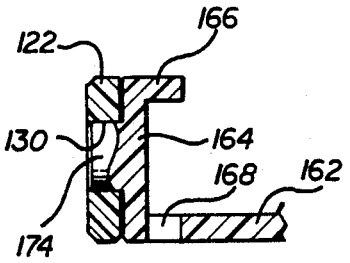
FIG. 4 is a sectional view taken along line 4—4 of FIG. 3 showing the connection of the slipcase to the frame of the mounting bracket.
Figure 7:
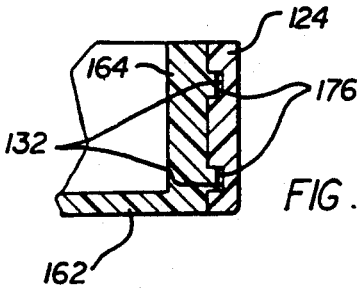
FIG. 7 is a sectional view taken along line 7—7 of FIG. 3 showing the connection of the frame to the slipcase of the mounting bracket.

The slipcase 38, shown in FIG. 2 includes a thin, flat, rectangular base 162 with a top, a bottom, and two sides, and a shoulder 164 extending at a right angle from the top, bottom and one side of the base 162. The other side of the base does not have a shoulder and has an entrance opening 160 for permitting insertion of the article into the slipcase. The top and bottom portions of the shoulder 164 each include a lip 166 extending in opposing, parallel relationship to the base 160 and spaced apart therefrom. The lips 166 are adapted to retain the article 20 in the slipcase 38 with the working surface of the article sufficiently exposed to the viewer for use. The shoulder 164 has an outward facing surface 170 and an inward facing surface 172. The outward facing surfaces of the top and bottom portions of the shoulder 164 of the slipcase 38 each include a cylindrical projection 174 formed integrally with the slipcase 38 and centered relative to the top and bottom portions, respectively, of the shoulder 164. Each cylindrical projection 174 is adapted to be rotatably received by the corresponding bore 130 in the end portions 122, 124 of the frame 32, thereby forming two pivots which define a rotation axis of the slipcase 38 (see FIG. 4). Openings 168 may be provided adjacent the projections 174 for injection molding purposes. The outward facing surfaces of the top and bottom portions of the shoulder 164 of the slipcase 38 each further include a pair of projections 176 between the cylindrical projection 174 and each side of the slipcase 38, equidistant from the cylindrical projection 176. Each pair of projections 176 is adapted to releasably engage the pair of notches 132 in the end portions 122, 124 of the frame 32, so as to releasably secure the slipcase 38 in a flat position relative to the frame 32 (See FIG. 7). Of course, the number and shape of the corresponding projections 176 and notches 132 may be varied as desired.

Figure 6:
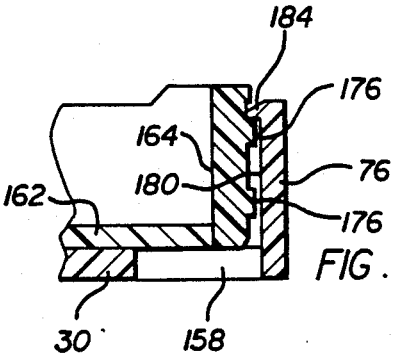
FIG. 6 is a sectional view taken along line 6—6 of FIG. 3 showing the connection of the panel to the slipcase of the mounting bracket.

The two posts 74 and 76 projecting from the relatively wider and thinner portion 86 of the panel 30, are adapted to secure the panel 30 to the cover 12, as well as to detentably secure the slipcase 38, along with the frame 32, in a substantially parallel adjoining relationship to the interior surface 44 of the front cover 12. Accordingly, the posts 74 and 76 each include a substantially flat vertically extending inner surface 178, 180. Each surface 178, 180 includes a hook 182, 184 respectively adapted to resiliently engage one of the projections 176, or even the top of the shoulder of the slipcase, in the outward facing surface 170 of the shoulder 164, of slip case 38 which is rotated to a most inward position (see FIG. 6). The hooks 182, 184 and projections 176 thus provide a detent to maintain the mounting assembly in the fully retracted position. The hook may engage either projection of the pair of projections 176, or even the top of the shoulder of the slipcase, depending on the thickness of the fabric on the cover 12. Openings 158 may be provided in the panel 30 near the posts 74 and 76 for injection molding purposes.

Figure 9B:
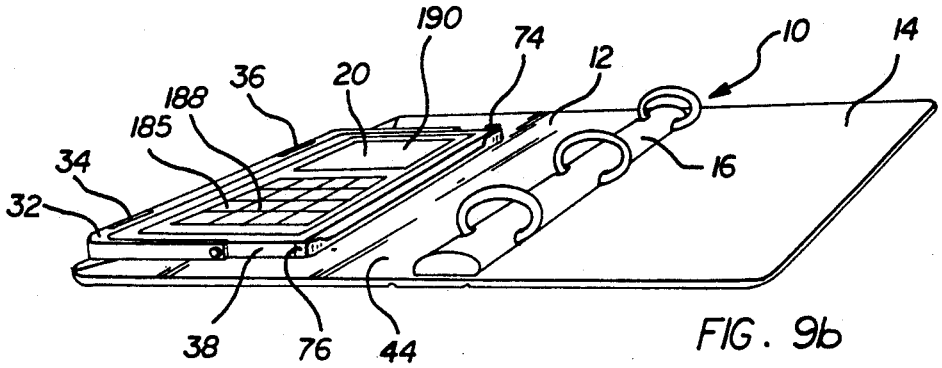
Figure 9C:
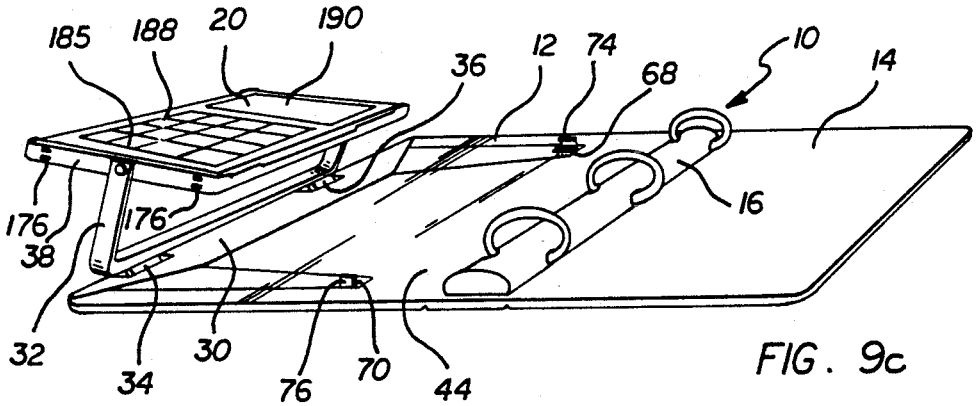
Figure 9D:
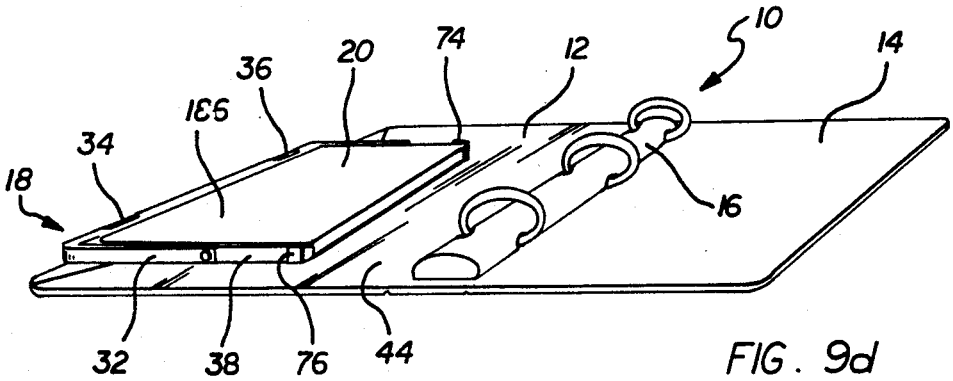

The two hinges 34 and 36 are adapted to allow the frame 32 to be movable between a first, retracted position in which the frame is in a substantially parallel adjoining relationship with the interior surface 44 of the front cover 12, as shown in FIG. 9*b*, and a second, extended position in which the frame 32 is in a substantially parallel adjoining relationship with the exterior surface 46 of the front cover 12, as shown in FIG. 1. Between these positions the frame 32 may be positioned alongside the front cover 12, as shown in FIG. 9*a*.

With reference to FIGS. 2 and 5, the hinge 34 is an elongated block having two ends, a rectangular, U-shaped notch 144 in one end and a like notch 146 in the opposite end. Each notch 144, 146 receives a pin 94 or 140 mounted transversely between the opposing sides of the notch 144, 146. Each notch 144, 146 is defined by a transverse bore 148, 150, respectively and a tapered slot 152, 154 between the bore 148, 150 and one side of the hinge 34. Each slot 152, 154 includes an entry portion wider than the pin 94 or 140 and a throat portion somewhat narrower than the pin 94 or 140, the two portions define a resilient detent that retains a pin within the bore 148 or 150. Each end of each connector 34, 36 is adapted to be received in the recess 90, 92, respectively, of the extension 60 and a recess 136, 138, respectively, of the frame 32.

Figure 8:
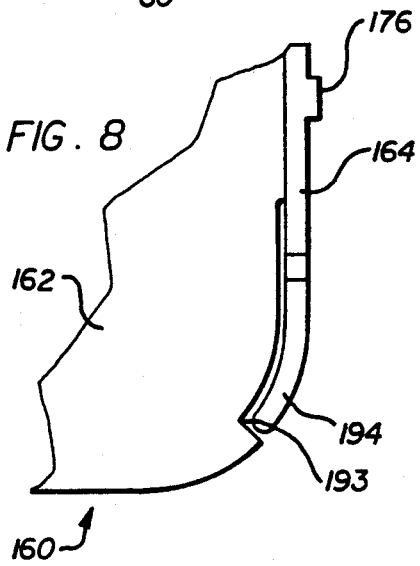
FIG. 8 is an enlarged view of the encircled portion of the slipcase shown in FIG. 3; and FIGS. *9a–9d* are perspective views of the binder shown in FIG. 1 in an open position with the electronic processor shown extending alongside the front cover and facing in the same direction as the interior of the front cover, shown in its retracted position, shown lifted off of the interior surface of the front cover and shown in a stowed position in which the front of the processor faces the interior surface of the front cover, respectively.

As shown in FIGS. 9*a*–9*d*, the electronic processor 20 may include a front working surface 185 and a back surface 186. The working surface 185 includes a keyboard 188 and a display 190. With reference now to FIGS. 3 and 8, the electronic processor 20 is secured within the slipcase 38 by the lips 166 extending from the shoulder 164 and by a pair of flexing fingers 192, 194. One flexing finger 192 extends from the top portion of the shoulder 164 at a right angle to the base 162 and wraps around to the entrance opening 160 of the slipcase. The other flexing finger 194 extends from the bottom portion of the shoulder 164 at a right angle to the base 162 and also wraps around to the entrance opening 160 of the slipcase. The flexing fingers are preferably integral to the shoulders and separated from the base by a gap 193 that enhances the resiliency of the flexing fingers. The wraparound portions of the fingers extend sufficiently into the entrance opening of the slipcase to assist in the securement of the article once it is positioned within the slipcase, but do not extend so far into the entrance opening to prevent insertion or removal of the article. By using the flexing fingers, the size of the shoulder 164 and lips 166 of the slipcase may be reduced in order to secure a given size article. In other words, the size, weight, bulk and expense of the slipcase may be reduced and a thinner, more compact, mounting bracket overall may be made to fit within the binder.

Since the slipcase 38 securing the electronic processor 20 is rotatable on the frame 32, and the frame 32 is pivotable between a first position in which it is fully retracted as shown in FIGS. 9*b* and 9*d* and a second position in which it is fully extended as shown in FIG. 1, it follows that in the binder 10 according to this invention the electronic processor 20 is positionable inside, outside, or alongside the binder 10, with the keyboard 188 and display 190 facing towards or away from the front cover 12.

When not in use, the electronic processor 20 is advantageously positionable in a stowed position (see FIG. 9*d*) in which the keyboard and display screen of the article face the interior surface 44 of the front cover 12, with each pair of projections 176 outward of the cylindrical projections 174 of the slipcase 38 releasably engaged in the pairs of notches 132 in the inner surface of the frame 32, and each pair of projections 176 to the right of the top and bottom cylindrical projections 174 of the slipcase 38 releasably engaged in the hooks 182, 184 in the posts 74 and 76, respectively, of the panel 30.

The electronic processor 20 is usable from the stowed position inside the binder 10 by disengagement of the projections 176 from the corresponding notches 132 in the frame, and the disengagement of the projections 176 from the corresponding hooks 182, 184 in the posts 74 and 76, followed by the rotation of the slipcase 180 degrees, and finally, the engagement of the projections 176 previously outward of the cylindrical projection 174 in the respective hooks 182, 184 in the posts 74 and 76, and the engagement of projections 176 previously inward of the cylindrical projection 174 in the notches 132 in the end portions 122, 124 of the frame 32 (see FIG. 9*b*).

Alternatively, the electronic processor 20 is positionable outside the cover 12, either alongside the front cover 12 or on top of the exterior surface 46 of the front cover 12. An article, assumed to be initially in the stowed position, is positionable on top of the exterior surface 46 of the front cover 12, with the keyboard and the display screen facing away from the front cover, without disengaging the projections 176 outward of the cylindrical projection 174 in the top and bottom portions of the shoulder 164 of the slipcase 38 from the notches 132 in the frame 32, with only the frame pivoted on hinges 34 and 36 after the disengagement of the projections 176 from the hooks 182, 184 in the posts 74 and 76 into a position in which the frame 32 is on top of the exterior surface 46 of the front cover 12 (see FIG. 1).

Alternatively, it may be beneficial to use the electronic processor 20 in conjunction with information found on pages contained within the notebook 10. After disengaging the slipcase from the posts, the frame 32 is pivoted on hinges 34 and 36 and the slipcase is rotated on its axis until the frame and slipcase are substantially aligned with the front cover 12 (see FIG. 9*a*).

In the embodiment of the invention described above, the relatively wider and thinner plate portion 86 of panel 30 is inserted into the flat pocket 62 in the front cover 12. It will be appreciated that since most binders are substantially symmetrical, a front cover would become the back cover upon turning the binder upside down. The one change needed to make an article usable in the new position would be to either turn the article upside down in the slipcase, or to turn the slipcase, along with the article, upside down in the frame.

In a slightly different embodiment of the invention the front cover 12 and back cover 14 may both be adapted to receive panels similar to the panel 30 of the invention. Such binders may be useful in applications requiring two different articles, or in applications in which it is convenient to access the article alternately on the left and right side of the binder.

The panel 30, frame 32, slipcase 38, and hinges 34, 36 are all advantageously injection molded from a semi-rigid thermoplastic material such as polycarbonate.

As will be appreciated from the above description, the present invention allows an article such as an electronic organizer or palm top computer to be securely attached to a cover of a binder so as to make it available for use on the inside of, outside of, or alongside the binder, in conjunction with, or independently of the information contained within the binder. Another benefit of the present invention is the ability to turn the article so that its keyboard and display screen face the interior or the exterior of the cover, and thereby are largely protected from damage in routine use. A further benefit of the invention is the ability to readily and completely remove the article from the slipcase by sliding the article out of the entrance opening of the slipcase past the flexing fingers.

While a particular embodiment of the invention has been illustrated and described for the purpose of enabling a person of ordinary skill in the art to make and use the invention, it will be appreciated that the invention is not limited thereto. Accordingly, any modifications, variations or equivalent arrangements within the scope of the attached claims should be considered to be within the scope of the invention.

What is claimed is:

1. A binder comprising a front cover, a rear cover, and a spine secured to the front and rear covers, each cover having an interior surface and an exterior surface, wherein at least one of the covers includes an inner edge hingedly connected to the spine, an outer edge, and further comprising:

a hinge pivotable attached to the one cover adjacent the outer edge thereof;

a slipcase pivotably mounted on the hinge, the slipcase having a rectangular base, a shoulder extending at a right angle along three sides of the base, the fourth side of the base and the shoulder defining an entrance opening into the slipcase, and a plurality of lips extending inwardly from the shoulder in spaced apart, parallel relationship to the base; and an article insertable into the slipcase through the entrance opening between a top surface of the base and the lips and having a working surface, whereby, upon rotation of the slipcase relative to the one cover, the article is movable between a stowed position in which the article is inside the binder on said interior surface of said one cover with the working surface facing the interior surface of the one cover and an extended position in which the article is outside the binder on said exterior surface of said one cover with the working surface facing away from the exterior surface of the one cover.

2. A binder according to claim 1, wherein the shoulder has a pair of flexing fingers, each of which extends from a respective side adjacent the entrance opening at a right angle to the base and wraps around onto the fourth side of the base such that the wraparound portions of the fingers extend sufficiently along the fourth side of the slipcase to assist in securement of the article positioned within the slipcase, but do not extend so far along the fourth side to prevent insertion or removal of the article.

3. A binder according to claim 2, wherein the flexing fingers do not contact the base.

4. A binder according to claim 1, further comprising means for securing the slipcase to the cover in the stowed position.

5. A binder according to claim 1, further comprising a post extending at a right angle from an inside surface of the one cover, said post having a hook portion for engaging the slipcase and securing the slipcase to the one cover.

6. A binder according to claim 1, wherein the hinge is an elongated block having two longitudinal notches, one notch for receiving a pin secured to the one cover and the other notch for receiving a pin secured to the slipcase.

7. A binder comprising a front cover, a rear cover, and a spine pivotally secured to the front and rear covers, each cover having an interior surface and an exterior surface, wherein at least one of the covers includes an inner edge hingedly connected to the spine, an outer edge, and further comprises:

a hinge attached to the one cover adjacent the outer edge thereof;

a frame mounted on the hinge for pivotable movement about a transversely extending axis, between a retracted position in which the frame is in a substantially parallel adjoining relationship with the interior surface of the one cover, and an extended position in which the frame is in a substantially parallel adjoining relationship with the exterior surface of the one cover;

a slipcase having a shoulder with two substantially parallel, opposing portions;

an article insertable into the slipcase; and means for rotating the slipcase relative to the frame such that upon the rotation of the slipcase relative to the frame the article is moveable between a stowed position in which the article faces the inside surface of the one cover and an operable position in which the article faces away from the inside surface of the one cover.

8. A binder according to claim 7, wherein the frame is generally U-shaped, having a center portion extending transversely along the outer edge of the one cover, and two end portions secured to the center portion that extend longitudinally, in parallel relationship, perpendicularly from the center portion and away from the outer edge of the one cover.

9. A binder according to claim 8, wherein:

each end portion includes a fixed end secured to the center portion and a free end removed from the center portion;

the center portion and the two end portions of the frame each include an outer edge and an inner edge and form a three-sided support structure defining a rectangular opening; and the slipcase is rectangular, substantially flat, wherein at least half of the slipcase fits within the rectangular opening when the slipcase is aligned with the frame.

10. A binder according to claim 9, wherein said means includes a cylindrical cavity on the inner edge of each end portion of the frame adjacent the free end thereof and a cylindrical projection on each of the two opposing portions of the shoulder of the slipcase, the projections centered with respect to the shoulder and adapted to be rotatably received in the cylindrical cavities of the frame.

11. A binder according to claim 7, wherein the hinge comprises:

at least one elongated connector for securing the frame to the one cover, having a first end and a second end; and at least one notch in the outer edge of the one cover adapted to receive and pivotally secure the first end of the connector; and at least one notch in the outer edge of the center portion of the frame adapted to receive and pivotally secure the second end of the connector.

12. A binder according to claim 11, wherein:

each notch in the outer edge of the one cover includes two opposing walls extending perpendicularly to the outer edge of the one cover, and further comprising a round pin extending between the walls of each notch, parallel to the outer edge of the one cover, for releasably engaging the first end of the connector;

each notch in the outer edge of the center portion of the frame includes two opposing walls extending perpendicularly to the outer edge of the center portion, and further comprising a round pin extending between the walls of each notch, parallel to the outer edge of the center portion, for releasably engaging the second end of the connector; and the connector defines a circular aperture extending therethrough, adjacent each end, and wherein the connector further defines a tapered slot extending between each aperture and one side of the connector, the slot having an entry portion wider than the pin, and a throat portion narrower than the pin, whereby each slot forms a resilient detent adapted to deform under pressure to allow the pin to pass through the slot and be pivotally received by the circular aperture.

13. A binder comprising:

a front cover, a rear cover, and a spine, each having an interior surface and an exterior surface, wherein at least one of said covers has an inner edge pivotably connected to said spine, an outer edge, and a flat pocket extending between the interior surface and the exterior surface of the one cover;

a panel having a wide, relatively thin portion and a narrower, relatively thick portion, the two portions each having an inner edge and an outer edge and being joined along their inner edges, wherein the thin portion of the panel is adapted to be inserted into the flat pocket of the one cover so that upon complete insertion of the thin portion into the flat pocket, the inner edge of the thick portion is in a substantially parallel abutting relation with the outer edge of the one cover;

a hinge secured to the thick portion of the panel, adjacent the outer edge thereof; and a frame secured to the hinge for pivotable movement between a retracted position in which the frame is in a substantially parallel relationship on top of the interior surface of the one cover and an extended position in which the frame is in a substantially parallel relationship on top of the exterior surface of the one cover;

a slipcase rotatably mounted on the frame; and an article secured to the slipcase.

14. A binder according to claim 13, wherein upon the rotation of the slipcase relative to the frame the article is moveable between a stowed position in which the article faces the one cover and an operable position in which the article faces away from the one cover.

15. A binder according to claim 14, wherein the slipcase includes a thin, flat and rectangular base having a top, a bottom, two sides, and a shoulder extending at right angle from the base on the top, the bottom and one side of the base, and wherein the top and bottom portions of the shoulder each include a lip extending in opposing, parallel relationship to the base.

16. A binder according to claim 15, wherein the article includes a front surface with a keyboard and a display screen, the keyboard and the display screen being exposed and accessible when the article is secured to he slipcase.

17. A binder according to claim 15, wherein the frame is generally U-shaped, having a center portion extending along the thick portion of the panel, and two end portions secured to the center portion that extend perpendicularly, in parallel relationship, from the center portion and away from the thick portion of the panel having a fixed end and a free end, the center portion and the two end portions of the frame each includes an inner edge and an outer edge and define a substantially rectangular opening, at least half of the slipcase fits within the rectangular opening when the slipcase is aligned with the frame.

18. A binder according to claim 17, wherein:

the top and bottom portions of the shoulder of the slipcase each includes a cylindrical projection extending away from the slipcase, along a common axis centered with respect to the top and bottom portions of the shoulder and a projection on either side of and equidistant from the cylindrical projection;

the inner edge of each end portion of the frame includes a cylindrical cavity adjacent the free end and an indentation in between the cylindrical cavity and the center portion of the frame wherein the indentations in each end portion of the frame are adapted to releasably engage one projection in the top and bottom portion of the shoulder thereby releasably securing the slipcase in alignment with the frame and wherein the cylindrical projections in the top and bottom portions of the shoulder of the slipcase are each adapted to be rotatably received in the cylindrical cavity in the inner edges adjacent the free end of the end portions of the frame.

19. A binder according to claim 18, wherein:

the panel includes two posts extending in parallel relationship at right angle from the thin portion of the panel, adjacent the outer edge thereof; and the interior surface of the one cover has two apertures adapted to admit the two post, thereby securing the panel to the one cover.

20. A binder according to claim 19, wherein the two posts are further adapted to releasably engage, the projections on the top and bottom shoulders, respectively, of the slipcase, not concurrently received in the indentations in the inner edges of the end portions of the frame while the slipcase is aligned with the frame and both the slipcase and the frame are in a substantially parallel adjacent relationship with the interior surface of the one cover.

21. A binder according to claim 17, wherein the hinge comprises:

at least one elongated connector for securing the frame to the panel, having a first end and a second end;

and at least one notch in the outer edge of the thick portion of the panel adapted to receive and pivotally secure the first end of the connector; and at least one notch in the outer edge of the center portion of the frame adapted to receive and pivotally secure the second end of the connector.

22. A binder according to claim 21, wherein:

each notch in the outer edge of the thick portion of the panel has two opposing walls extending perpendicularly to the outer edge of the thick portion, and further comprises a round pine extending between the walls of the notch, parallel to the outer edge of the thick portion, for releasably engaging the first end of the connector;

each notch in the outer edge of the center portion of the frame has two opposing walls extending perpendicularly to the outer edge of the center portion, and further comprises a round pin extending between the walls of the notch, parallel to the outer edge of the center portion, for releasably engaging the second end of the connector; and wherein each connector defines a circular aperture extending therethrough adjacent each end, and wherein each connector further defines a tapered slot extending between each aperture and one side of the connector, the slot having an entry portion wider than the pin, and a throat portion narrower than the pin, whereby each end of the connector defines a detent deformable under pressure and adapted to resiliently receive and to secure the pin.

23. A binder/attachment combination, comprising:

a binder having a front cover, a back cover and a spine secured to the front and back covers, wherein at least one of the covers has an interior surface, an exterior surface, an inner edge hingedly connected to the spine and an outer edge, and wherein the outer edge defines at least one opening having a first pin secured therein, said first pin disposed parallel to the outer edge of the one cover;

an attachment for supporting an article, said attachment having a side edge defining at least one opening having a second pin secured therein, said second pin disposed parallel to said side edge; and a hinge in the form of an elongated block having two parallel longitudinal notches, one notch pivotably receiving the first pin and the second notch pivotably receiving the second pin, whereby said attachment is rotatably supported between a first position wherein said article is inside the binder on said interior surface and a second position wherein said article is outside the binder on said exterior surface.

24. The binder/attachment combination of claim 23 further comprising means for securing said attachment to said interior surface of said one cover when the attachment is in the first position, said means including a post that extends perpendicularly from the interior surface and is disposed in contacting relationship with an outer edge of the attachment when the attachment is in the first position.

25. A binder/attachment combination, comprising:

a binder having a front cover, a back cover and a spine secured to the front and back covers, wherein at least one of the covers has an interior surface, an exterior surface, an inner edge hingedly connected to the spine and an outer edge;

an attachment for supporting an article, said attachment having a side edge;

a hinge pivotably attached to the one cover adjacent the outer edge thereof and pivotably attached to the attachment adjacent the side edge thereof, whereby said attachment is rotatably supported between a first position wherein said article is inside the binder on said interior surface and a second position wherein said article is outside the binder on said exterior surface; and means for securing said attachment to said interior surface of said one cover when the attachment is in the first position, said means including a post that extends perpendicularly from the interior surface and is disposed in contacting relationship with the attachment when the attachment is in the first position.

26. The binder/attachment combination of claim 25, wherein the side edge of the attachment is disposed between a top end and a bottom end of the attachment and wherein said means includes a second post that extends perpendicularly from the interior surface and is disposed in contacting relationship with the attachment when the attachment is in the first position, said posts further disposed on opposite sides of the attachment at the top end and bottom end thereof.

* * * * *